United States Patent [19]

Ford-Dunn

[11] 4,066,050

[45] Jan. 3, 1978

[54] TWO-STROKE I.C. ENGINES

[75] Inventor: Martin Douglas Ford-Dunn, Steyning, England

[73] Assignee: Ricardo & Co., Engineers (1927) Limited, Shoreham-by-Sea, England

[21] Appl. No.: 642,307

[22] Filed: Dec. 18, 1975

[30] Foreign Application Priority Data

Dec. 18, 1974 United Kingdom ..... 54633/74

[51] Int. Cl.[2] ..... F02B 33/04

[52] U.S. Cl. ..... 123/73 SP; 123/73 A; 123/73 PP

[58] Field of Search ..... 123/73 R, 73 A, 73 PP, 123/73 SP, 73 V, 74 A

[56] References Cited

U.S. PATENT DOCUMENTS

| | | | |
|---|---|---|---|
| 2,058,526 | 10/1936 | Tanner | 123/73 A |
| 3,195,524 | 7/1965 | Heidner | 123/73 A |
| 3,613,646 | 10/1971 | Hisada | 123/73 V |
| 3,815,558 | 6/1974 | Tenney | 123/73 PP |

FOREIGN PATENT DOCUMENTS

| | | | |
|---|---|---|---|
| 865,233 | 12/1952 | Germany | 123/73 A |
| 809,265 | 5/1951 | Germany | 123/73 PP |

*Primary Examiner*—Ronald H. Lazarus
*Assistant Examiner*—David D. Reynolds
*Attorney, Agent, or Firm*—Cushman, Darby & Cushman

[57] ABSTRACT

A two-stroke internal combustion engine has a plurality of transfer ports controlled by the movement of the piston, the transfer ports being at the ends of passages each extending from the interior of the crankcase through the cylinder wall so as to place the crankcase interior in communication with the upper working space in the cylinder above the piston when its associated transfer port is uncovered by downward movement of the piston. Some, but not all, of the transfer port passages are provided with pressure-responsive non-return valves which are lightly spring-biassed towards closed positions in which they restrict the gas flow through those passages, in the direction towards the upper working space in the cylinder, causing the gas flow from the crankcase to travel at increased velocities through the remaining transfer port passage or passages. When the pressure differential between the crankcase interior and the upper part of the cylinder exceeds a predetermined minimum value the non-return valves open to permit bulk gas flow through their associated transfer port passages and their associated ports.

7 Claims, 8 Drawing Figures

TWO-STROKE I.C. ENGINES

BACKGROUND TO THE INVENTION

This invention relates to two-stroke internal combustion engines, and is concerned with improvements to the porting arrangements of such engines.

In a two-stroke engine, during the working stroke of the piston fresh mixture of air and fuel is being compressed in the crankcase by the downward movement of the piston driven by the expansion of the charge ignited in the combustion chamber. When the piston reaches a predetermined point in its working stroke it uncovers one or more exhaust ports in the cylinder wall through which the expanded combustion gases are discharged to atmosphere, and shortly afterwards it uncovers transfer (scavenge) ports at the ends of passages in the wall of the cylinder which place the crackcase interior in communication with the cylinder space above the piston crown, so that a fresh charge of mixture previously compressed in the crankcase will flow through the transfer ports into the upper working space in the cylinder above the piston. After a suitable period the transfer ports and the exhaust ports are reclosed by the piston wall as the piston moves upwardly on the compression stroke and compresses the fresh charge in the cylinder prior to its ignition and the start of the next working stroke.

Fresh mixture is sucked into the crankcase as the piston rises in its compression stroke, through inlet ports controlled by the skirt of the piston or through non-return valves or timed valves in the crankcase wall, and shortly after the piston reaches its top-dead-centre position these inlet ports or valves close to trap the fresh mixture in the contained volume afforded by the crankcase and the lower part of the cylinder below the piston, in readiness for compression by the descending piston during the next working stroke of the cycle.

In practice it is necessary to design the number, size and disposition of the transfer ports and exhaust ports, and their respective passages leading to the ports, including their inclination, in such a way that as much as possible of the exhaust gases from each cycle are swept out or "scavenged" through the exhaust ports, in order that as much fresh mixture as possible will be retained in the cylinder to produce power in the next cycle. At the same time it is desirable that as little of the fresh mixture as possible should short-circuit from the transfer ports to the exhaust ports before ignition, in the interests of good fuel economy and low exhaust emission.

A secondary, but vital, function of the transfer ports is to create a pattern of internal mixture movement (gas flow) in the combustion chamber and the upper part of the cylinder, which is favourable to efficient and regular combustion.

In the case of a two-stroke engine whose fuel supply is controlled by a carburettor, the power output is controlled by throttling the mixture intake immediately downstream of the carburettor. This produces a sub-atmospheric gas pressure in the crankcase prior to compression by the working stroke, and the crankcase pressures after compression are somewhat lower than those prevailing at full throttle, i.e. full-load operation. The porting details in such engines are usually designed to produce maximum power output when running at full throttle, and a lighter load operation the flow velocities through the transfer ports will be reduced due to the lower crankcase pressures referred to. The Applicant believes that the poor low-load running of this type of two-stroke engine is due to excessive dilution of the fresh charge by the inevitably higher proportion of exhaust residuals left in the cylinder. In particular the amount of fresh charge at a readily-ignitable mixture strength reaching that part of the combustion chamber where ignition is initiated is inadequate for regular combustion, due to the reduced gas flow velocities through the cylinder transfer ports.

BRIEF SUMMARY OF THE INVENTION

An object of the present invention is to reduce these drawbacks and produce improved low-load operation by effecting an increase in the gas flow velocities through the transfer ports.

According to the present invention, at least one, but not all, of the transfer port passages is provided with a gas-pressure-responsive non-return valve which controls the gas flow through the passage and is lightly biassed towards its closed position whereby the valve will restrict the gas flow through the opened port into the upper part of the cylinder except when the pressure difference between the crankcase and the upper part of the cylinder reaches or exceeds a certain minimum value sufficient to open the valve.

Thus when the engine is running at light loading the crankcase pressures will be low and the or each of the biassed non-return valves will be held closed by its biassing means, thus causing the whole or the greater part of the intake of fresh mixture to flow through the transfer port passage or passages with no non-return valve. This increased gas flow volume produces increased flow velocities through the unrestricted passage or passages. These higher flow velocities are expected to produce a considerably improved scavenging and mixture distribution with respect to the spark plug, than is possible with a conventional arrangement of unrestricted transfer passages, and hence to do much to improve light load operation, including a reduction in exhaust emissions due to reduced misfiring and less irregular combustion.

It will be understood that it is not essential that the or each valve should effect a gas-tight seal with the associated transfer port passage when in the closed position. It is quite possible to use a leaky, ill-fitting or otherwise non-sealing valve, or even one with a restricted-flow aperture in the movable valve member, provided that when in the closed position the valve has the effect of significantly restricting the gas flow through the transfer port, by producing a small predetermined or predeterminable pressure drop in the gas flow path along the transfer port passage, whereby the greater proportion of the scavenging gas from the crank case to flow through the transfer port passage or passages which are not valve-controlled in the interest of good scavenging and mixture distribution.

DESCRIPTION OF THE DRAWINGS

One specific embodiment of this invention will now be described by way of example only, and with reference to the accompanying drawings, in which:

In the illustrated embodiment, a cylinder 10 of a two-stroke carburettor engine is provided with twin exhaust ports 11, and with two pairs of transfer ports with passages 12A, 12A and 12B, 12B which interconnect the interior of the crankcase 13 and the upper part of the cylinder 10, all these ports being controlled by the wall of the piston 14. In FIG. 1, the piston 14 is shown near its bottom dead-center position, in a position in which the transfer ports and the exhaust ports are fully open. Each of the transfer port passages is outwardly- and upwardly- inclined over its lower part and is inwardly- and upwardly-inclined over its upper part. One pair of the transfer port passages, 12A, 12A has the ports at its upper ends opening through regions of the cylinder wall which are roughly diametrically opposed to one another, and the gas flows from these two ports enter the cylinder in opposite directions, with approximately-radial horizontal components of direction and velocity. The ports of the other two transfer port passages 12B, 12B enter the cylinder at spaced regions generally opposite to the exhaust port 11, and the gas flows into the cylinder from these two ports have opposite, generally-tangential horizontal components.

Figure 4A:
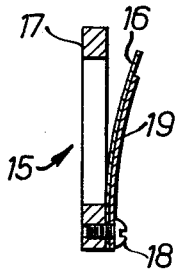
FIG. 4A is a detail showing in cross-section one of the non-return reed valves.
Figure 4B:
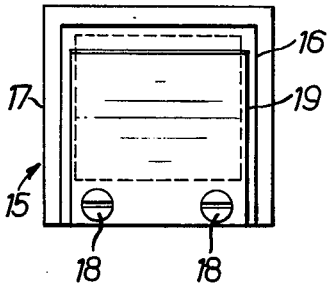
FIGS. 4B and 4C are respectively a rear view and a perspective view of the reed valve of FIG. 4A.
Figure 4C:
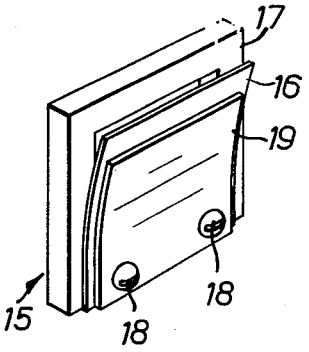

Each of the two transfer port passages 12A, 12A is provided in its length with a non-return valve 15 of reed type, as shown in FIG. 4.

Figure 1:
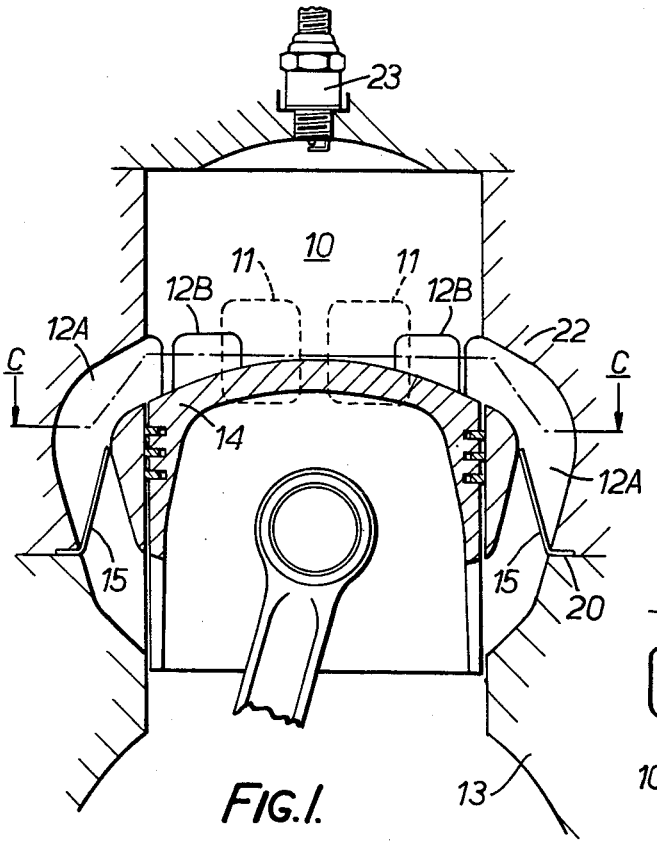
FIG. 1 is a diagrammatic elevational view of one cylinder of a two-stroke engine, in section on the line A—A in FIG. 2.
Figure 3:
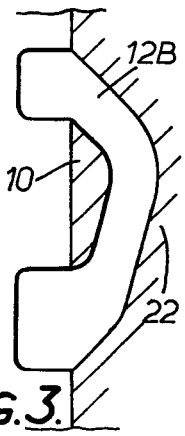
FIG. 3 is a part-section on the line B—B of FIG. 2.
Figure 2:
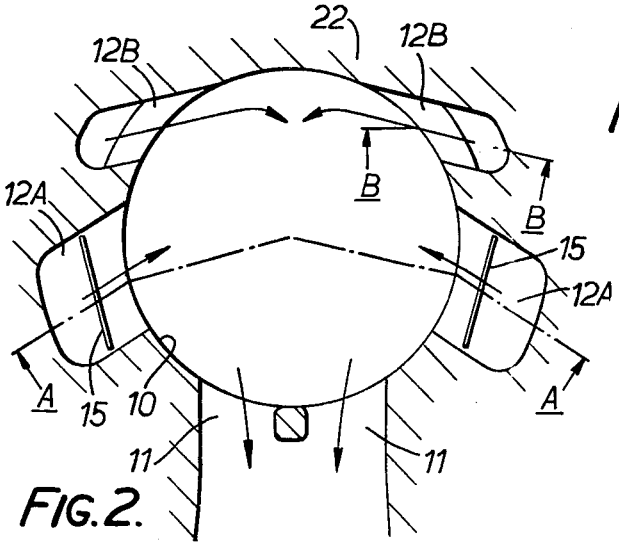
FIG. 2 is a cross-section on the line C—C of FIG. 1.
Figure 5:
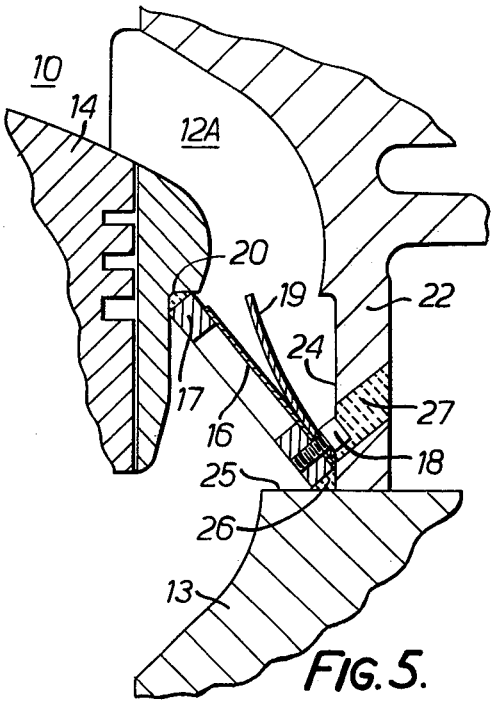
FIGS. 5 and 6 are detailed views showing two ways of securing the reed valves in the transfer port passages.
Figure 6:
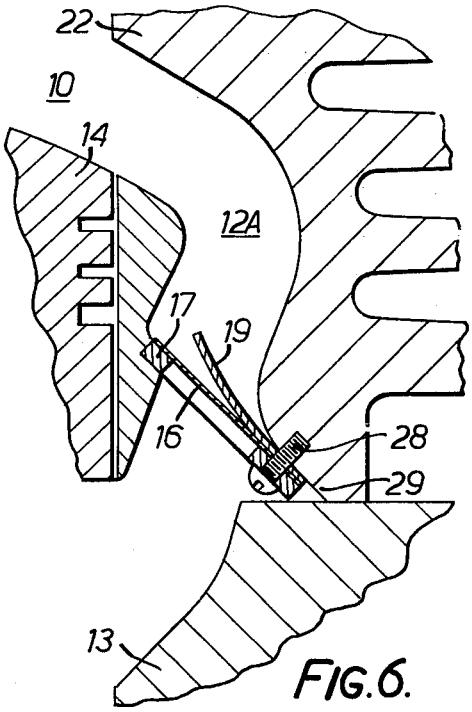

Each reed valve 15 is lightly resiliently- biassed towards its closed position, and closes the associated transfer port passage 12A so long as the pressure difference between the interior of the crankcase and the upper working part of the cylinder is low and does not exceed a predetermined value. Each reed valve 15 comprises a thin resilient flap 16 of spring steel, known as the reed and anchored rigidly at one edge to a seating ring 17 by means of screws or rivets 18, and backed by a stiff curved backing member 19 which acts as an abutment for the valve flap or reed 16 at full opening thereby limiting the working stress level in the reed 16. The flexural elasticity of the reed causes it to return to its seat on the ring 17 when the applied gas pressure difference is removed. As shown, diagrammatically only in FIGS. 1 and 2 and in detail in FIGS. 5 and 6, each reed valve 15 is mounted in the outwardly-inclined lower portion of the associated transfer port passage 12A, with its seating ring oblique to the length of the passage. Each valve seating may be retained in position in the transfer port passage 12A by being trapped at one edge behind a step 20 formed in the wall of the passage 12A and at the opposite edge in a corner formed between meeting surfaces 24 and 25 respectively of the cylinder block 22 and of the crankcase casting 13, as shown in FIG. 5, the seating ring being sealed in the passage 12A by a filling of refractory cement 26. Access lids 27 for the retaining screws 18 are also filled with the cement. Alternatively as shown in FIG. 6 the seating ring 17 may be secured in the transfer port passage 12A by means of screws 28 extending into tapped holes in the wall of the passage to hold the ring 17 against an inclined surface 29 of the cylinder block 22 close to its junction with the crankcase casting 13.

At low-load operation with partial throttle openings, when the pressure difference across the reed valves 15 is below the said predetermined value, the two transfer port passages 12A, 12A will be closed by the valves 15, and the entire induced flow of fresh mixture from the crankcase into the cylinder will pass through the other two transfer port passages 12B, 12B which are not valved, the gas flows through the ports at the ends of these two passages being at correspondingly higher velocities. These increased gas velocities will improve scavenging and mixture distribution in the region of the spark plug 16, as well as producing improved gas turbulence in the combustion chamber.

At full load, with full throttle openings, the increased crankcase pressures will ensure that the valves 15 open and allow gas flow through all four transfer ports, at adequately-high velocities.

As indicated above, the valves 15 need not necessarily seal in a gas-tight manner with the respective transfer port passages when in their closed positions, provided they then create a sufficient restriction to the free flow of gas through the associated transfer port passages to ensure that the greater part of the mixture flow from the crankcase travels through the other two transfer port passages at correspondingly-increased flow velocities.

Moreover pressure-responsive non-return valves of a different construction may be employed instead of reed check valves as the valves 15. For example, carefully-engineered light-weight automatic face-seating disc poppet valves of zero seat angle, lightly spring-loaded towards the closed position, might be used as the valves 15, for engines operating up to fairly high speeds.

Whilst in the illustrated arrangement it is the two diametrically-opposed transfer port passages 12A, 12A which are valved, it would of course be possible to leave these two passages without valves and to put the biassed reed valves 15 into the other two transfer port passages 12B, 12B if desired.

What we claim as our invention and desire to secure by Letters Patent is:

1. A two-stroke internal combustion throttle controlled engine with crankcase compression and scavenging, comprising:

a cylinder having a wall, a piston slidable inside the cylinder wall upwardly by a compression stroke to a top dead center position and downwardly by a working stroke to bottom dead center position, a crankcase below said cylinder and having an inlet port for receiving a throttle controlled combustible air-fuel gaseous mixture which is subject to compression within the crankcase by said piston during its downward working stroke to effect a relatively low mixture pressure at low load operation with partial throttle and a relatively high mixture pressure at full load operation with full throttle, a plurality of transfer ports formed in said cylinder wall with their upper limits all at the same predetermined distance below the top dead-center piston position and being controlled by movement of said piston so that all the transfer ports will start to be uncovered simultaneously by the descending piston, exhaust port means in said cylinder wall and means to ensure operation thereof before said transfer ports are uncovered by said piston, a plurality of transfer port passages extending through the cylinder wall and communicating at their lower ends with the interior of said crankcase and at their upper ends with said transfer ports, and hence with the upper working space in the cylinder above the piston when the piston reaches a predetermined level on its downward working stroke and uncovers the transfer ports, at least one but not all of said transfer port passages having an unrestricted gas flow path from end to end for scavenging the said upper working space in the cylinder by the said mixture compressed during each downward working stroke, and means for improving the scavenging effectiveness of said mixture and combustion conditions during said low load operation by increasing then the velocity of said mixture via at least said one passage and respective transfer port into said upper working spaces, said velocity increasing means being characterized by gas pressure responsive check valve means disposed in at least one other of said transfer passages and responsive solely to the pressure of said mixture in said crankcase and being normally biased towards its closed position for restricting passage of said low pressure mixture through said other transfer passage during said low load operation and thereby increasing the said velocity at said one port to cause said improved scavenging and combustion conditions, said valve means being automatically opened up by the relatively high pressure of said crankcase mixture at said full load operation and by intermediate crankcase pressures which exceed the pressure in said upper working space in said cylinder.

2. An engine as claimed in claim 1 in which said check valve means when in its closed position makes a close sealing fit with its seating and completely closes the associated transfer port passage.

3. An engine as claimed in claim 1 in which said check valve means is of resilient reed type.

4. An engine as claimed in claim 1 having four transfer ports, the passages of two only of which are provided with said check valve means.

5. An engine as claimed in claim 4 in which the two transfer ports whose passages are provided with said check valve means are respectively on opposite sides of the cylinder and discharge generally radially inwardly into the cylinder.

6. An engine as claimed in claim 5 in which the other two transfer ports are on the same side of the cylinder with respect to the first-mentioned two transfer ports and discharge generally tangentially and convergently into the cylinder, and which is provided with at least one exhaust port in the opposite side of the cylinder.

7. An engine as claimed in claim 1 in which each transfer port passage which is provided with said check valve means has an upwardly and outwardly inclined lower portion leading from the crankcase interior, and an upwardly and inwardly inclined upper portion leading from the lower portion into the upper working space in the cylinder, said check valve means being mounted in an oblique attitude in the lower portion of the transfer port.

* * * * *